United States Patent [19]

Kahl

[11] Patent Number: 4,747,693

[45] Date of Patent: May 31, 1988

[54] LABORATORY MIXER

[76] Inventor: Murray Kahl, 12083 Regal Ct. W., West Palm Beach, Fla. 33414

[21] Appl. No.: 936,647

[22] Filed: Nov. 20, 1986

[51] Int. Cl.[4] ..... B01F 11/00; A47B 73/00; B01L 3/00

[52] U.S. Cl. ..... 366/208; 366/219; 211/74; 422/99; 422/104

[58] Field of Search ..... 366/110, 111, 208, 215, 366/219; 211/71, 74; 422/99, 101-104

[56] References Cited

U.S. PATENT DOCUMENTS

| | | | |
|---|---|---|---|
| 3,061,280 | 10/1962 | Kraft et al. | 366/110 |
| 3,159,384 | 12/1964 | Davis | 366/110 |
| 3,850,580 | 11/1974 | Moore et al. | 366/277 X |
| 4,042,218 | 8/1977 | Moore et al. | 366/111 |
| 4,057,148 | 11/1977 | Meyer et al. | 211/74 |
| 4,118,801 | 10/1978 | Kraft et al. | 366/111 |
| 4,305,668 | 12/1981 | Billbrey | 366/111 |
| 4,389,374 | 6/1983 | Sutton et al. | 422/104 |

FOREIGN PATENT DOCUMENTS

| | | | |
|---|---|---|---|
| 1498929 | 4/1969 | Fed. Rep. of Germany | 211/74 |

*Primary Examiner*—David Werner
*Attorney, Agent, or Firm*—Michael J. Striker

[57] ABSTRACT

A tray for uniformly mixing fluent material contained within a plurality of vessels, the tray having a restraining plate, restraining the vessels at a first location thereof against movement, and a vessel engaging element arranged to engage the plurality of vessels at a second location thereof and being spaced away from and rotatably movable relative to the restraining plate for shaking all the vessels over a uniform path when the vessels are thereby engaged and restrained. The frequency of shaking is adjustable and its duration can be set for a specific period of time.

15 Claims, 2 Drawing Sheets

LABORATORY MIXER

BACKGROUND OF THE INVENTION

The present invention relates generally to an apparatus for mixing fluent material in which vessels are agitated eccentrically to produce a vortex mixing action. In particular, the mixer of the present invention is intended for use in laboratories and the like to agitate vessels, such as test tubes.

Laboratory mixers are known in the art. A typical apparatus is illustrated in U.S. Pat. No. 3,850,580. In such mixers, the vessel, such as a test tube, beaker or flask, is manually held against a resilient top surface, which is driven eccentrically. In this manner, the vessel is agitated. The surface is large enough to accommodate several test tubes or a flask. The degree of agitation transmitted to a vessel depends upon the force with which the vessel is held against the resilient surface.

Such a mixer, however, is not suitable for situations requiring a mass uniform mixing of test tubes. It is not possible to uniformly mix test tubes where multiple test tubes are manually pressed against a resilient surface simultaneously, especially where the degree of agitation is dependent upon the force applied. The human hand simply can not provide a uniform force in such cases.

Another mixer is known from U.S. Pat. No. 3,061,280. Here, a vessel, usually a test tube, is held in or against a cupshaped member which is eccentrically driven to agitate the vessel. The amount or degree of agitation can be manually adjusted by changing the throw or rotational speed of the eccentric drive.

With this type of mixer, it is not possible to agitate several test tubes at one time and manual adjustment or the agitation can be difficult when the vessel is being manually held against the eccentrically driven member.

SUMMARY OF THE INVENTION

It is the object of the present invention to provide a tray for holding a plurality of vessels containing fluent material to be mixed, so that a uniform mixing can be provided.

In keeping with this object, and others which will become apparent hereafter, one aspect of the invention resides, briefly stated, in a tray for uniformly mixing fluent material contained within a plurality of vessels, the tray having restraining means arranged for restraining a plurality of vessels at a first location thereof against movement and a vessel engaging element arranged to engage the plurality of vessels at a second location thereof and spaced away from and rotatably movable relative to the restraining means for shaking all the vessels over a uniform path when the vessels are thereby engaged and restrained.

Another object is to engage, restrain, and retain vessels by a vessel holder so that the vessels shake in conjunction with agitation of the vessel holder and without manual handling.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENT

Figure 1:
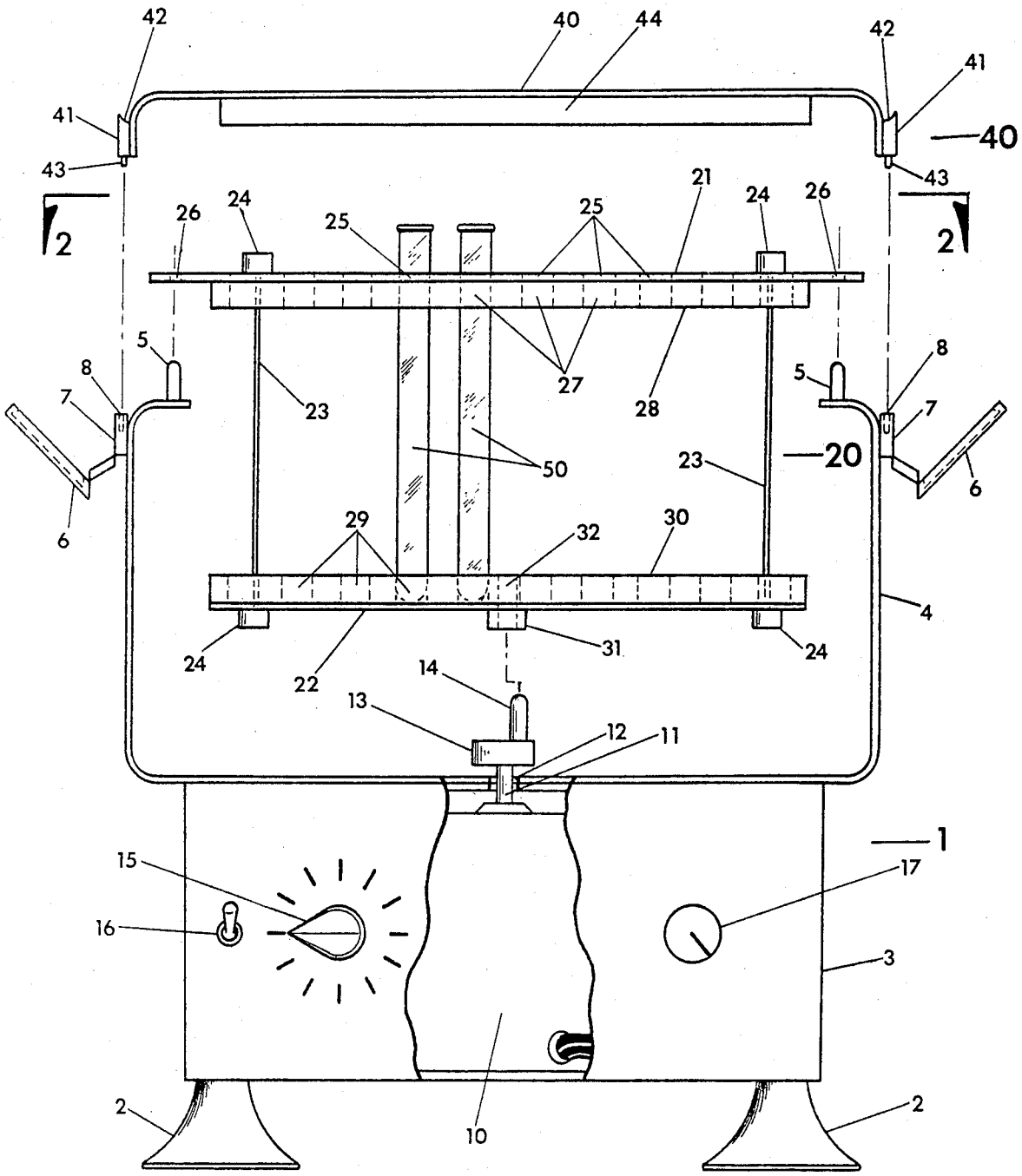
FIG. 1 is an exploded front side elevation view of the mixer, with the base partly broken away and in section. Dotted lines indicate how the pieces are fitted together.
Figure 2:
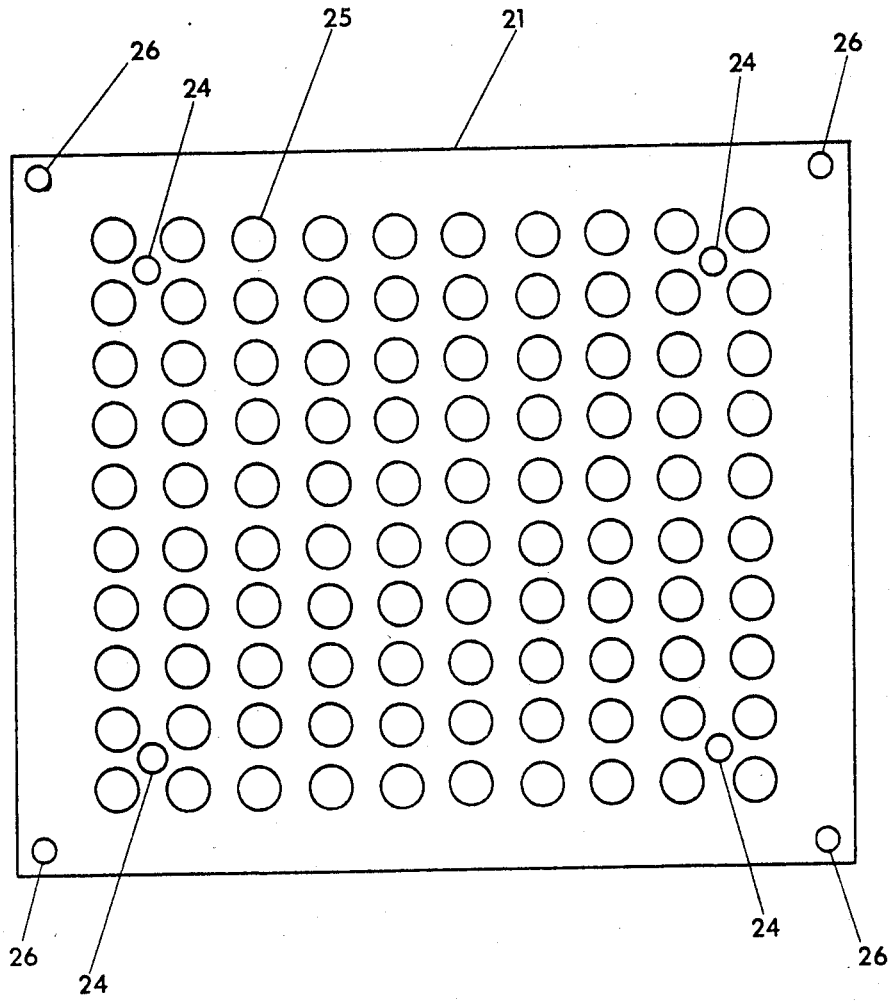
FIG. 2 is a top view of the vessel holder as viewed from lines 2—2 of FIG. 1.

Referring now to the drawings, a housing 1 has four rubber suction cups or legs 2 which adhere to a surface. The base 1 has an enclosed bottom base 3 immediately above the legs 2 and two opposite walls 4 extending vertically upward above the enclosed bottom portion 3. The walls 4 are bent horizontally toward each other at their upper most part.

The housing 1 supports a vessel holder 20. Extending upward from each horizontally bent portion of both walls 4 of the base 1 is a projection 5. Preferably, the two projections 5 are diagonally across from each other. The vessel holder 20 has an upper plate 21 and a lower plate 22 connected to each other by means of four symmetrically arranged connecting rods 23. The connecting rods 23 pass through small drilled holes in the plates and are held in place above the upper plate and below the lower plate by clamps 24, which are wider in diameter than the small holes and are fastened to the plates.

The upper plate 21 rests on the upper bent portions of the base side walls 4. Thus, the upper plate 21 is wider than the lower plate 22.

The upper plate 21 also has drilled holes 26, into which projections 5 are inserted, so that the upper plate 21 is fixed against horizontal movement relative to the housing 1. The connecting rods 23 are flexible, which permits movement of the lower plate 22 relative to the upper plate 21.

A plurality of test tubes 50 pass through a corresponding plurality of drilled holes 25 in the upper plate 21 and through a respective plurality of holes 27 in a resilient layer 28 on the bottom of the upper plate 21 and with a respective plurality of holes 29 in another resilient layer 30 on the top of the lower plate 22. All the holes 25, 27 and 29 are vertically aligned with each other so that the test tubes 50 may rest on the lower plate 22 and be held in place in the accommodating holes 27 and 29 of the resilient layers. The diameter of the upper plate holes 25 is larger than the diameter of the test tubes 50 and the upper plate resilient layer holes 27, thereby affording some clearance for the test tubes 50 to rotate.

Fasteners 6 are provided to fasten the lid 40 and housing 1 together. A pair of flexible fasteners 6 are secured at one end to the upper outside of each of the vertical walls 4. The other end of fasteners 6 is movable and engages extended members 41 located on the outer surface of bent vertical sides of the lid 40. The extended member 41 has a slot 42 into which the fasteners 6 are fitted and thereafter snapped closed. The fastener 6 has a portion 7 secured to the wall 4. This portion 7 has a slot 8 with its opening facing upward. The extended member 41 has an extension 43 which fits into the slot 8 of the fastener's portion 7.

The lid 40 has a resilient layer 44 on the underside of its central portion. When the lid is fastened to the housing 1, the tops of all the test tubes 50 press into the resilient layer 44 of the lid 40 to retain and prevent independent vertical movement of the test tubes 50. Thus, the test tubes 50 can only move in conjunction with movement of the vessel holder 20.

A motor 10 located centrally within the base 3 rotates a shaft 11 projecting upward through a hole 12 from the base 3. The shaft 11 is connected to a coupler 13, from which an eccentrically placed shaft 14 extends upward. As a result, the shaft 14 rotates in an eccentrical manner.

The lower plate 21 has a centrally located hole 32 and an extended tube 31 of the same diameter extending downward from the hole 32, thereby defining a passage for the shaft 14. In this manner, eccentric rotation of the shaft 14 causes the lower plate 22 to move accordingly, thereby causing the lower portions of all the test tubes 50 to agitate. The resilient layer 30 on the lower plate 22 may also have a hole aligned with, and of the same diameter as, the hole 32 to further define a passage for the shaft 14. With the shaft 14 elongated to pass through this resilient layer 30, contact is assured with the lower plate 21.

As described, all the test tubes 50 shake in unison and are agitated by an equal amount of force throughout. This comes about because the lower plate 22 engages all the test tubes 50 simultaneously, imparting an equal force from the eccentric drive. Further, the upper plate 21 restrains the movement of the test tubes 50 at a different location equally.

The apparatus may be left to run for any amount of time, thereby freeing manpower and affording the possibility of agitation of any amount of vessels for extended periods of time.

In addition, a timer 15 is used to set the duration of agitation. The timer 15 is inside the base 3 and connected to the motor 10. A three-way switch 16 is used for setting the mixer to OFF, STEADY ON and TIMED operation.

Further, the frequency of agitation of the test tube 50 contents may be adjusted at any time by regulating 17 the speed of the motor 10, which may be a variable speed motor. The speed control circuit may be placed within the base 3.

It will be understood that each of the elements described above, or two or more together, may also find a useful application in other types of mixers differing from the types described above.

While the invention has been illustrated and described as embodied in a laboratory mixer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for the various applications without omitting features that, from the standpoint of prior art, fairly constitute essential characteristics of the generic or specific aspects of this invention.

What is claimed is new and desired to be protected by Letters Patent is set forth in the appended claims.

I claim:

1. A holder for uniformly mixing fluent material contained within a plurality of vessels, the holder comprising:

restraining means including a restraining plate arranged for restraining a plurality of vessels at a first location thereof against movement;

vessel engaging means including a vessel engaging plate arranged to engage the plurality of vessels at a second location thereof and spaced away from and rotatably movable relative to said restraining means for shaking all the vessels over a uniform path when the vessels are thereby engaged and restrained by said vessel engaging plate and said restraining plate respectively; and means for flexibly connecting said engaging and restraining plates together so as to allow movement of said engaging plate relative to said restraining plate, said flexibly connecting means including at least one flexible connecting rod connected at one end thereof with said engaging plate and at another end thereof with said restraining plate.

2. The holder as defined in claim 1; further comprising: means for retaining vessels containing the fluent material to be mixed in place when the vessels are restrained by said restraining means and engaged by said vessel engaging means.

3. The holder as defined in claim 2; further comprising:

a housing, said restraining means being detachably securable to said housing, said retaining means including a lid arrangable over the vessels, said lid being detachably fastenable to said housing.

4. The holder as defined in claim 3, wherein said lid has an underside arrangable for facing toward the vessels, said retaining means further including a layer of resilient material on said underside contactable with the vessels.

5. The holder as defined in claim 3, further comprising:

fastening means for detachably fastening said lid to said housing.

6. The holder as defined in claim 1, wherein said restraining plate has a first plurality of holes, through which the vessels are insertable.

7. The holder as defined in claim 6, wherein said vessel engaging plate has a top surface; and further comprising: retaining means including a layer of resilient material on said top surface, said layer having a second plurality of holes aligned with said first plurality of holes in said restraining plate, said engaging and restraining plates being arranged so that when the vessels are inserted through said first plurality of holes and into second pluralities of holes, the vessels rest on said engaging plate and yet are restrained by said restraining plate.

8. The holder as defined in claim 1; further comprising:

a housing, said restraining means being detachably securable to said housing.

9. The holder as defined in claim 8; further comprising:

means for adhering said housing to a surface including at least one suction cup.

10. The holder as defined in claim 1; further comprising:

eccentric drive means operatively connected to said vessel engaging plate and operative for eccentrically rotating the latter relative to said restraining means.

11. The holder as defined in claim 10, wherein said eccentric drive means includes eccentric connectors engaging said vessel engaging plate and a motor for driving said eccentric connectors.

12. The holder as defined in claim 10; further comprising:

timing means connected with said eccentric drive means so as to actuate the latter for a predetermined period of time.

13. The holder as defined in claim 10, wherein said driving means is variable speed; further comprising:

means for adjusting said variable speed of said driving means.

14. A tray for uniformly mixing fluent material contained within a plurality of vessels, the tray comprising:

restraining means arranged for restraining a plurality of vessels at a first location thereof against movement;

a vessel engaging element arranged to engage the plurality of vessels at a second location thereof and spaced away from and rotatably movable relative to said restraining means for shaking all the vessels over a uniform path when the vessels are thereby engaged and restrained by said vessel engaging element and said restraining means respectively, said restraining means including a restraining plate with a first plurality of holes, through which the vessels are insertable, said restraining plate having a bottom surface; and retaining means including a layer of resilient material on said bottom surface, said layer having a second plurality of holes aligned with and having a diameter smaller than that of said first plurality of holes in said restraining plate so that when said vessels are inserted through said first and said second pluralities of holes, the said layer of resilient material forming said second plurality of holes contacts and retains the vessels.

15. A tray for uniformly mixing fluent material contained within a plurality of vessels, the tray comprising:

restraining means arranged for restraining a plurality of vessels at a first location thereof against movement;

vessel engaging means arranged to engage the plurality of vessels at a second location thereof and spaced away from and rotatably movable relative to said restraining means for shaking all the vessels over a uniform path when the vessels are thereby engaged and restrained by said vessel engaging means and said restraining means respectively, said vessel engaging means including an engaging plate, said restraining means including a restraining plate; and means for flexibly connecting said engaging and restraining plates together so as to allow movement of said engaging plate relative to said restraining plate, said flexibly connecting means including at least one clamp member releasably fastened to one of said plates said flexibly connecting means further including at least one flexible connecting rod secured to the other of said plates and extending to said clamp member fastened to said one of said plates, said flexible connecting rod and said clamp member being formed so that said flexible connecting rod is held into position by said clamp member when said clamp member is tightened to fix a relative distance between said plates and so that said flexible connecting rod is released when said clamp member is loosened to permit movement of said plates relative to each other so that said relative distance corresponds to a height of the vessels to be restrained and engaged.

* * * * *